US005409353A

United States Patent [19]

Imbault

[11] Patent Number: 5,409,353

[45] Date of Patent: Apr. 25, 1995

[54] TURBOMACHINE ROTOR WITH BLADES SECURED BY PINS

[75] Inventor: Jean-François Imbault, Saint Fargeau Ponthierry, France

[73] Assignee: Societe Nationale D'Etude Et De Construction De Moteurs D'Aviation "Snecma" , Paris, France

[21] Appl. No.: 181,086

[22] Filed: Jan. 13, 1994

[30] Foreign Application Priority Data

Jan. 14, 1993 [FR] France ..... 93.00276

[51] Int. Cl.[6] ..... F01D 5/30

[52] U.S. Cl. ..... 416/212 A; 416/214 A; 416/217; 416/220 R; 416/222; 416/230

[58] Field of Search ..... 416/212 A, 214 A, 219 R, 416/217, 220 R, 222, 230

[56] References Cited

U.S. PATENT DOCUMENTS

| | | | |
|---|---|---|---|
| 3,014,695 | 12/1961 | Rankin et al. | 415/220 X |
| 3,051,436 | 8/1962 | Kent et al. | 416/220 |
| 3,694,104 | 9/1972 | Erwin | 415/230 |
| 4,008,000 | 2/1977 | Gradl et al. | 416/214 A |
| 4,098,559 | 7/1978 | Price | 416/230 R |
| 4,966,527 | 10/1990 | Merz | 416/230 |
| 5,145,319 | 9/1992 | Glowacki | 416/230 |

FOREIGN PATENT DOCUMENTS

| | | |
|---|---|---|
| 0429353A1 | 5/1991 | European Pat. Off. . |
| 872416 | 4/1953 | Germany . |

*Primary Examiner*—Edward K. Look
*Assistant Examiner*—Michael S. Lee
*Attorney, Agent, or Firm*—Oblon, Spivak, McClelland, Maier & Neustadt

[57] ABSTRACT

A turbomachine rotor includes a disk having a plurality of annular ribs projecting from its periphery to define a plurality of annular grooves, and a plurality of blades, preferably made of composite material, evenly distributed around the periphery of the disk, each blade having a notched root defining heels which fit into the grooves of the disk and which are divided into two groups, one group being offset on the pressure side of the blade and the other group being offset on the suction side so that the heels of the second group align with the heels of the first group of an adjacent blade, the blades being fixed to the disk by pins which extend through the aligned heels of adjacent blades and the ribs of the disk. Each blade is thus secured by two pins, and each pin helps to secure two blades.

5 Claims, 5 Drawing Sheets

TURBOMACHINE ROTOR WITH BLADES SECURED BY PINS

BACKGROUND OF THE INVENTION

Field of the Invention

The present invention relates to a turbomachine rotor of the type comprising a disk having a plurality of annular ribs which project radially outwardly from the periphery of the disk and define a plurality of annular grooves extending around the periphery, and a plurality of blades which are secured to the disk, the blades being evenly distributed around the periphery of the disk and extending radially therefrom, and each blade having a notched root defining a plurality of heels which fit into respective grooves of the disk.

In particular the invention relates to a fan rotor fitted with large chord blades made of a composite material, in which the blades do not incorporate platforms and their roots have comb-type fixings.

Discussion of the Prior Art

U.S. Pat. No. 3,694,104 discloses a blade made of composite material having a notched root defining heels, each heel being provided with a metal bush defining a hole intended to cooperate with a fixing pin. The root of the blade is fixed to the ribs of the rotor disk by means of two axially offset pins, one situated on the upstream side of the blade in the plane of the leading edge and the other on the downstream side in the plane of the trailing edge.

This arrangement does not enable the pins to take up the entirety of the forces applied to the blades. Also, the added platforms interposed between the blades are required to take-up the tangential components of the forces, and they must be rigid and firmly secured to the disk by fixing screws, which increases the weight of the rotor. Furthermore, the angular offset existing between the axis of the upstream pin and the axis of the downstream pin of each blade creates difficulties in the construction of the blade and of the disk. Finally, certain pins and fixing screws are mounted from the front face of the disk, and others from the rear face. This requires the rotor to be dismounted if the blades are to be removed.

SUMMARY OF THE INVENTION

The aim of the present invention is to remedy these drawbacks, and to provide a turbomachine rotor of the kind described in which the means for fixing the blades to the disk take-up the entirety of the forces exerted on the blades.

Accordingly, the invention provides a turbomachine rotor comprising a disk having a periphery formed with a plurality of annular ribs projecting radially outwardly to define a plurality of annular grooves extending around the periphery of said disk, a plurality of blades mounted on the periphery of said disk, said blades being evenly distributed around said disk and projecting radially therefrom, each of said blades having a pressure side, a suction side, and a notched root defining a plurality of heels which fit into said plurality of grooves of said disk, and fixing means securing said blades to said disk, wherein said heels of each blade are divided into a first group which is offset on said pressure side of said blade and a second group which is offset on said suction side of said blade, said first group of heels of each blade is aligned with said second group of heels of an adjacent blade to form an aligned row of heels, each of said aligned rows of heels and said ribs are provided with an aligned row of holes therethrough, and said fixing means comprises pins extending completely through said aligned rows of holes.

As a result of this arrangement the blades are secured by parallel pins evenly spaced around the periphery of the disk, each blade being secured by two pins and each pin holding two blades, which permits the mass of the assembly to be reduced.

Preferably, the pins are parallel to the axis of the disk, and are all inserted through the aligned rows of holes from the same side.

Preferably each of the blades is made of a composite material which includes fibers, and the heels of the blade each includes a bush defining the hole through the heel, the fibers of the composite material passing around the bushes and extending towards the outer end of the blade.

Preferably the heels of the second group which is offset on the suction side of the blade are disposed in the central part of the blade root.

Other preferred features and advantages of the invention will become apparent from the following description of the preferred embodiments, given by way of example only, with reference to the attached drawings.

DESCRIPTION OF THE PREFERRED EMBODIMENTS

Figure 4:
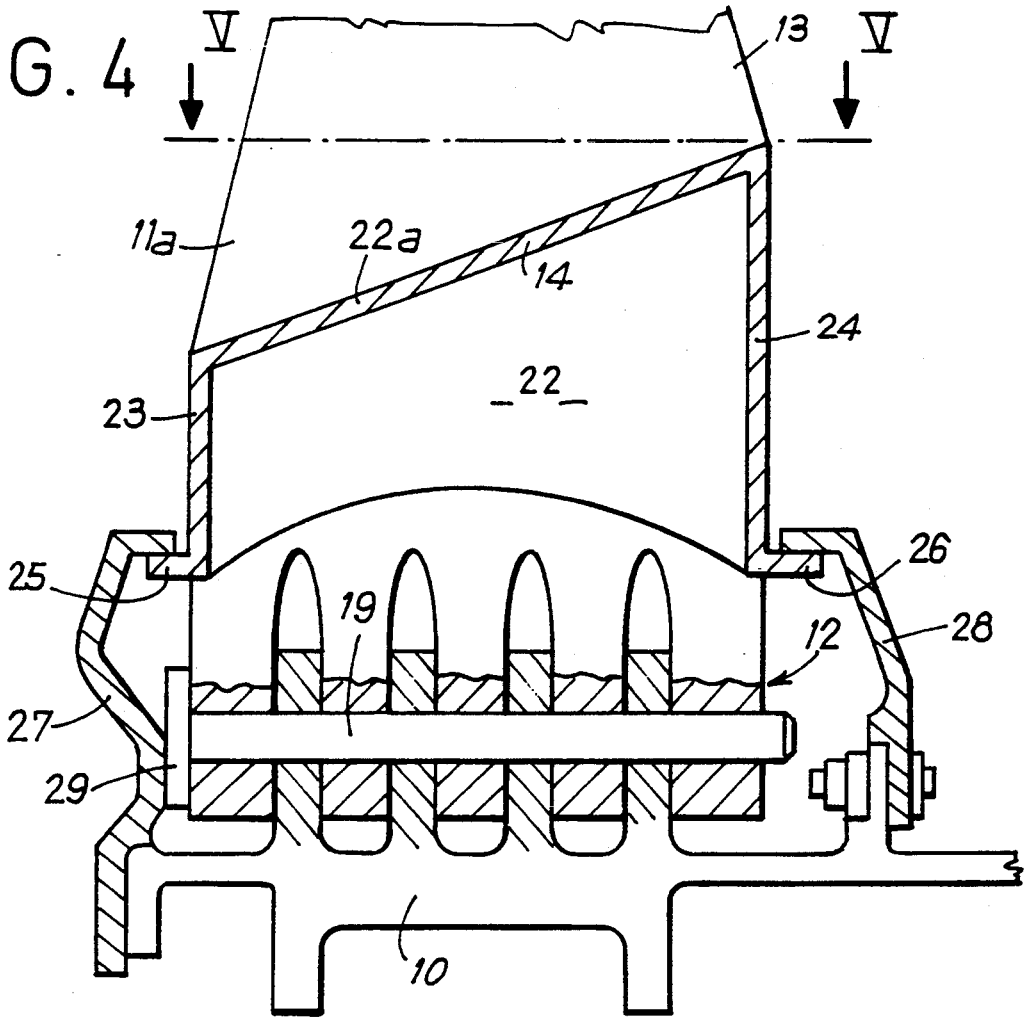
FIG. 4 is a view similar to FIG. 1 but showing a second embodiment in which platforms are fitted to the rotor and disk between the blades.
Figure 5:
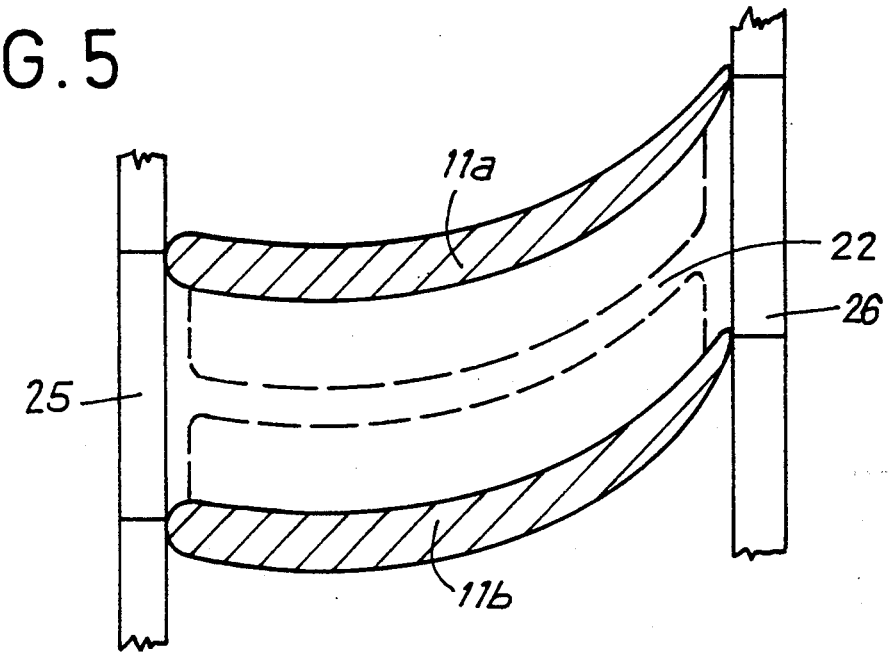
FIG. 5 is a partial section of the second embodiment taken along line V—V of FIG. 4.

The turbomachine rotor 1 in the embodiments shown in the drawings comprises a rotor disk 10, in the form of a wheel rim, and a plurality of blades 11 secured to the disk and evenly distributed around its circumference, each blade 11 comprising a root 12 for fixing it to the disk 10 and an aerodynamic blade portion 13 which extends radially outwards from the periphery of the disk 10. Separate platforms 14 may be added between the blades 11, such as shown in FIGS. 4 and 5, to define the inner wall of the path for the flow of gas upstream to downstream between the blades 11 during operation of the rotor 1.

For the connection of the blades 11 to the disk 10, the latter has a plurality of annular ribs 15 which project radially outwards from its periphery, and which define a plurality of annular grooves 16. In addition, each blade root has radial notches matching the annular ribs 15 and defining heels 17 which fit into the grooves 16 between the annular ribs 15.

In the embodiments shown, each blade 11 has five heels 17, respectively denoted by letters A, B, C, D, E from upstream to downstream of the turbomachine, and in accordance with the invention these are divided into two groups, the first group of heels being offset on the pressure side of the blade 11 and aligned with each other, and the second group of heels being offset on the suction side and also aligned with each other. Furthermore, the two groups of heels are offset in such a manner that the heels of the first group of each blade 11 align with the heels of the second group of an adjacent blade to form an aligned row of heels 18.

Figure 1:
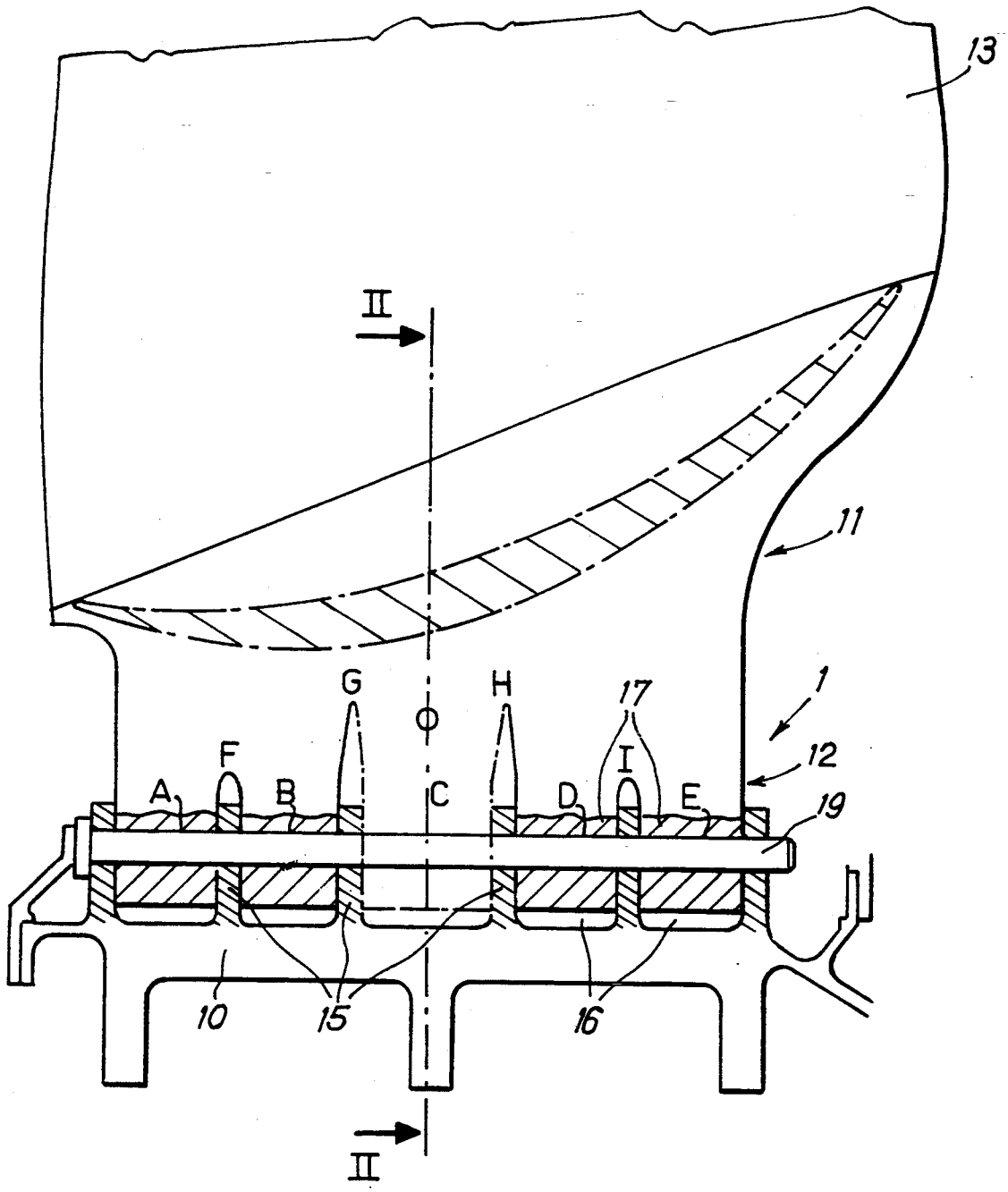
FIG. 1 is an axial section through part of a first embodiment of a turbomachine rotor in accordance with the invention taken along a plane passing through one of the fixing pins.
Figure 2:
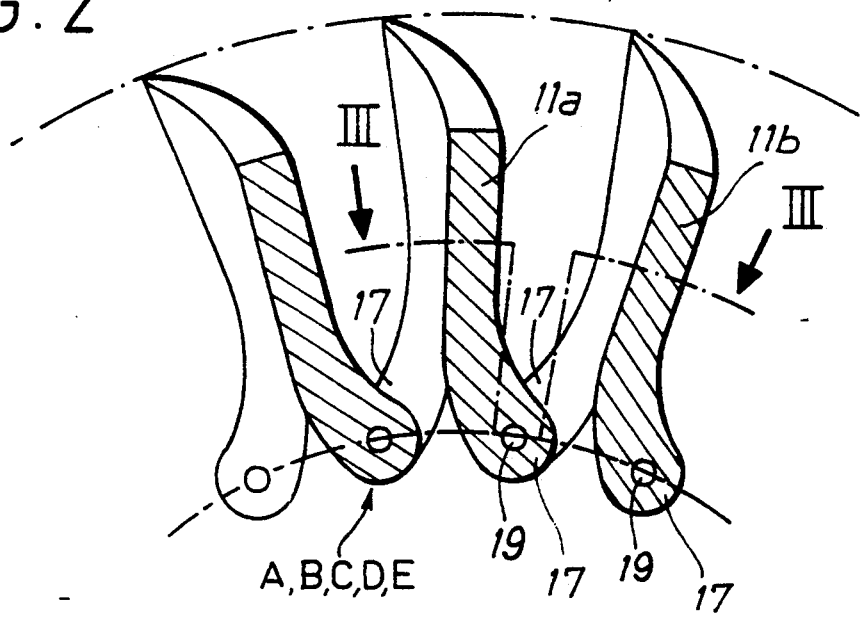
FIG. 2 is a radial section through a part of the first embodiment taken along line II—II of FIG. 1.
Figure 3:
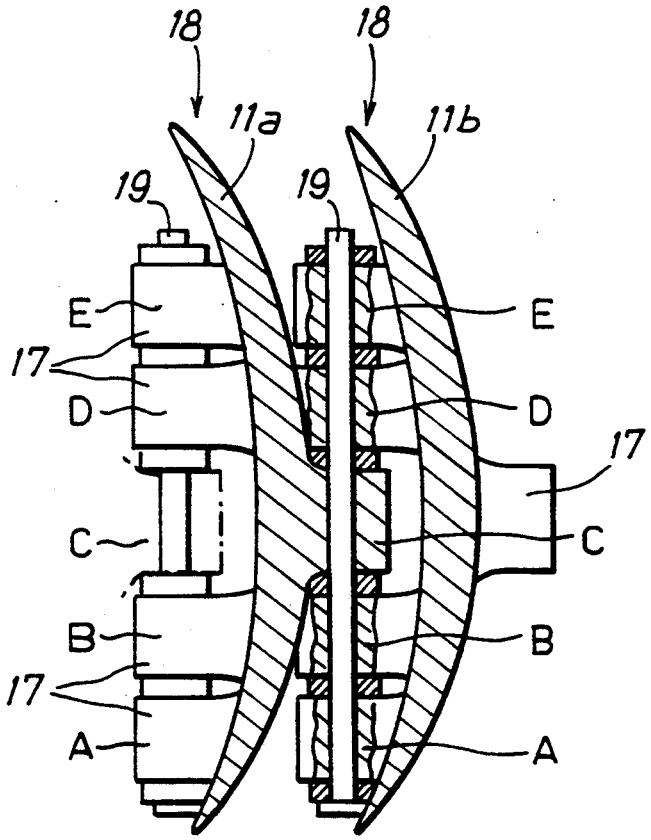
FIG. 3 is a section taken along line III—III of FIG. 2.

In the embodiments shown, there is only one heel in the second group of heels of each blade, namely the heel C situated in the middle part of the blade root 12, but the second group could include several consecutive or non-consecutive heels 17. As may be clearly seen in FIG. 3, the heel C of the blade 11*a* is disposed between the heels B and D of the adjacent blade 11*b*.

The blades 11 are fixed to the disk 10 by a plurality of pins 19, one for each of the aligned rows of heels 18. The heels of each aligned row 18 have aligned holes which register with aligned holes in the ribs 15, and the respective pin 19 extends completely through the aligned holes of the heels and the ribs.

As a result of this arrangement, each blade 11 is fixed to the disk 10 by two adjacent pins 19, and each pin 19 holds two consecutive blades. Preferably all the pins 19 are inserted from the same side of the disk 10 and are parallel to the axis of the rotor.

The two adjacent pins 19 which hold each blade 11 are angularly spaced apart relative to the rotor axis, and take-up the radial and tangential components of the forces exerted on the blade 11.

Figure 6:
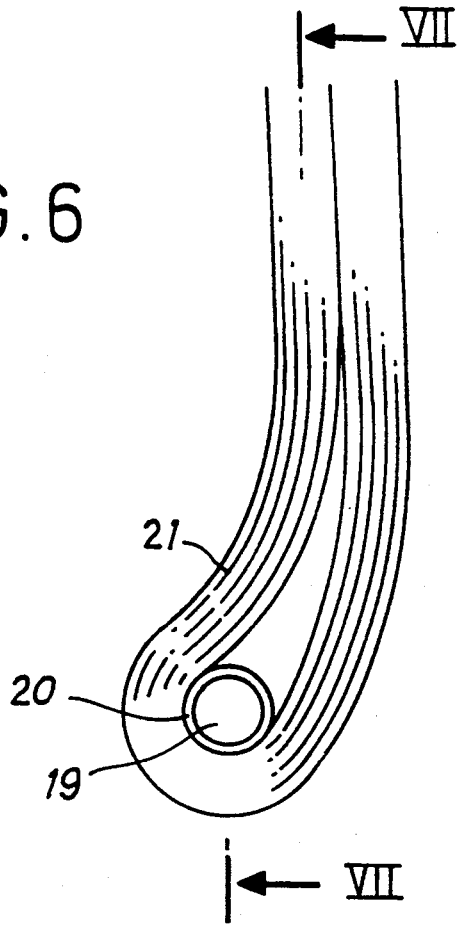
FIG. 6 is a cross-section through part of the root of a blade for a rotor in accordance with the invention.
Figure 7:
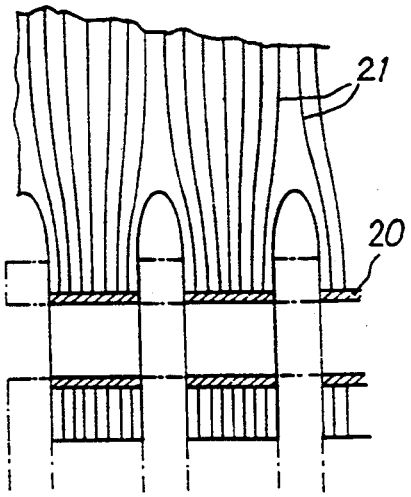
FIG. 7 is a section through part of the root taken along line VII—VII of FIG. 6; and, FIG. 8 is a side view of a complete blade.

Preferably, each heel 17 is fitted with a bush 20 defining the hole through which the pin passes, particularly when, as is preferred, the blades are made of a composite material. In this case, the fibers 21 of the composite material forming the aerodynamic portion 13 of the blade preferably extend around the bushes 20 of the blade heels 17 as illustrated in FIGS. 6 and 7, extending from the pressure side of the blade to its suction side, to ensure the continuity of the centrifugal loads.

Figure 8:
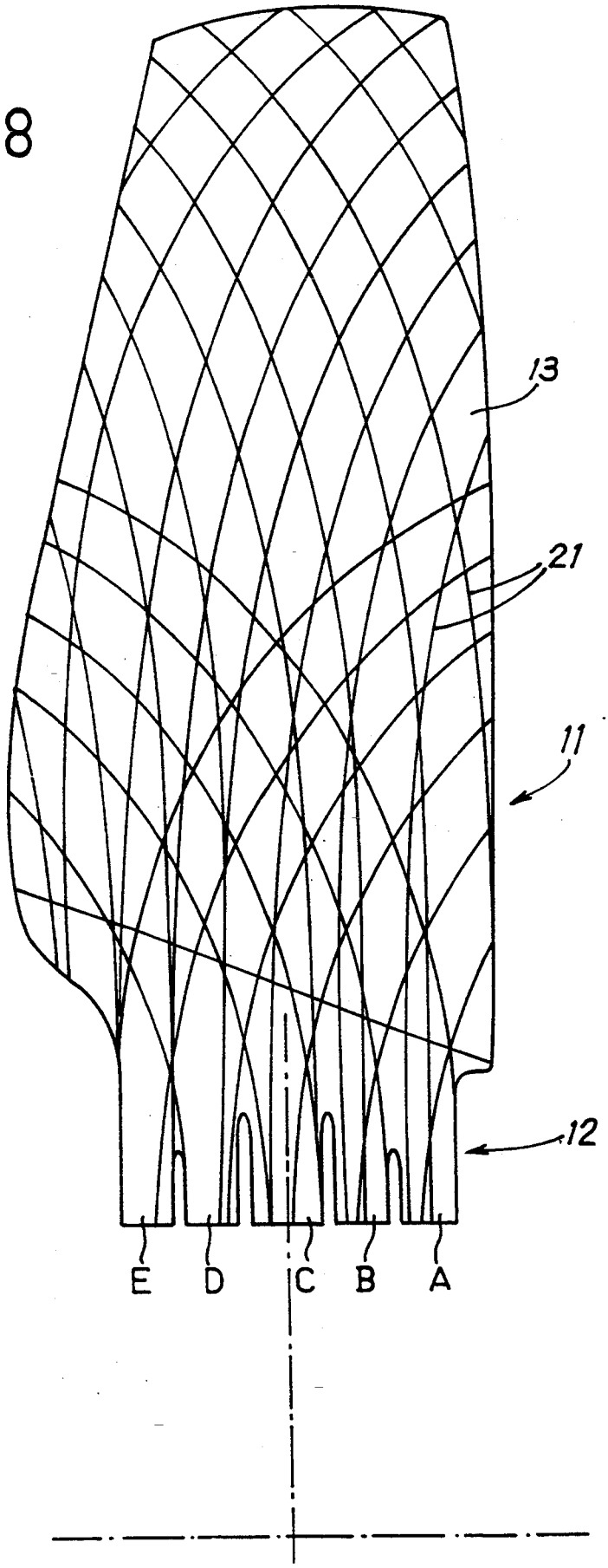

As will be seen in FIG. 8, the fibers 21 are preferably arranged in a crossed manner over the entire height of the blade portion 13. Some fibers proceed from the leading edge side of the blade towards the other trailing edge side and return on the other face of the blade, crossing with other fibers which have followed a reverse symmetrical path. The complete assembly of the fibers 21 constitutes a bag which, in association with excellent strength at the connection, ensures greater protection against the deterioration of the profile after an impact, as a result of the fact that this arrangement of the fibers 21 permits, in the case of most impacts, retention of the pieces of blades bound by this crossed meshwork.

As mentioned earlier, platforms 14 may be fitted between adjacent blades 11, such as in the second embodiment shown in FIGS. 4 and 5. In this embodiment each platform 14 has a central rib 22 which bears on the junction between the two adjacent blades 11*a* and 11*b*, a radially outer wall 22*a* which is inclined relative to the axis of the rotor and extends between the facing surfaces of the two blades 11*a* and 11*b*, and upstream and downstream end walls 23 and 24 extending radially towards the axis of the rotor 1. The inner edges of these walls 23 and 24 have axial flanges 25 and 26 which are held by rings 27 and 28 fixed to the disk 10. The front ring 27 also acts as a retainer for the heads 29 of the pins 19.

The assembly of the rotor 1 is effected as follows. A first blade 11*b* is placed on the disk 10 in such a manner that holes through the ribs 15 are aligned with the bushes 20 of the heels 12 of the blade. A second blade 11*a* is then placed on the disk 10 in a similar manner and so that the central heel C of the second blade is located between the heels B and D of the first blade 11*b*, and a pin 19 is inserted through the holes of the aligned heels and the registering holes of the ribs. This same procedure is then followed for each successive blade until all of the blades 11 have been fitted and secured. After this, the platforms 14 are set in place, and the rings 27 and 28 are secured so as to hold the platforms 14 and the pins 19 in position. The rotor is dismantled by following the reverse procedure.

The above described embodiments are particularly suitable for fan rotors having large chord blades made of composite material.

I claim:

1. A turbomachine rotor comprising:

a disk, said disk having a periphery formed with a plurality of annular ribs projecting radially outwardly from said disk to define a plurality of annular grooves extending around the periphery of said disk;

a plurality of blades mounted on the periphery of said disk, said blades being evenly distributed around said disk and projecting radially therefrom, each of said blades having a pressure side, a suction side, and a notched root defining a plurality of heels which fit into said plurality of grooves of said disk; and, pins securing said blades to said disk;

wherein said heel of each blade are divided into a first group which is offset on said pressure side of said blade and a second group which is offset on said suction side of said blade, said first group of heels of each blade is aligned with a second group of heels of an adjacent blade to form an aligned row of heels, each of said aligned rows of heels and said ribs are provided with an aligned row of holes therethrough, wherein said pins respectively extend completely through said aligned rows of holes.

2. A rotor according to claim 1, wherein said pins are all inserted through said aligned rows of holes from the same side of said disk.

3. A rotor according to claim 2, wherein said pins are parallel to the axis of said disk.

4. A rotor according to claim 1, wherein each of said blades is made of a composite material which includes fibers, and said heels of said blades each includes a bush defining said hole therethrough, said fibers of the composite material passing around said bushes and extending towards the outer end of the blade.

5. A rotor according to claim 1, wherein the heels of said second group which is offset on said suction side of said blade are disposed in the central part of said blade root.

* * * * *